United States Patent [19]

Striebig

[11] Patent Number: 4,631,999

[45] Date of Patent: Dec. 30, 1986

[54] BOARD SAW

[75] Inventor: Ludwig Striebig, Lucerne, Switzerland

[73] Assignee: Striebig AG, Switzerland

[21] Appl. No.: 608,344

[22] Filed: May 8, 1984

[30] Foreign Application Priority Data

May 9, 1983 [CH] Switzerland ..... 2527/83

[51] Int. Cl.[4] ..... B27B 5/06; B27B 5/18

[52] U.S. Cl. ..... 83/471.2; 83/486; 83/488; 83/455; 83/574

[58] Field of Search ..... 83/471.2, 486, 488, 83/471.3, 455, 574, 563

[56] References Cited

U.S. PATENT DOCUMENTS

| | | | |
|---|---|---|---|
| 3,008,498 | 11/1961 | Olson | 83/486 |
| 3,122,183 | 2/1964 | Striebig | 83/486 X |
| 3,213,908 | 10/1965 | Schultz et al. | 83/488 X |
| 3,866,496 | 2/1975 | Payne et al. | 83/486 X |
| 4,150,597 | 4/1979 | Striebig | 83/488 X |

*Primary Examiner*—Donald R. Schran

*Attorney, Agent, or Firm*—Pahl, Lorusso & Loud

[57] ABSTRACT

A board saw exhibits a frame on which a guide beam is horizontally slidable. A sawing unit is mounted with vertical mobility on the guide beam and is connected by a cable to a compensating weight. In order to absorb the reaction forces generated by the saw reliably in the immediate sawing region, a horizontal support beam is mounted for vertical displacement and likewise connected by a cable to a compensating weight. The installation is preferably wired so that the support beam follows automatically to the level of the saw blade when the sawing unit is pivoted into the horizontal cutting position.

For an accident-proof support of the board (P), a row of support arms is provided on the upper girder of the frame and also on the movable support beam, and these support arms are arranged staggered so that when the support beam is raised they interlace comb fashion and ensure a correct accident-proof support of the board.

6 Claims, 1 Drawing Figure

BOARD SAW

Figure 1:
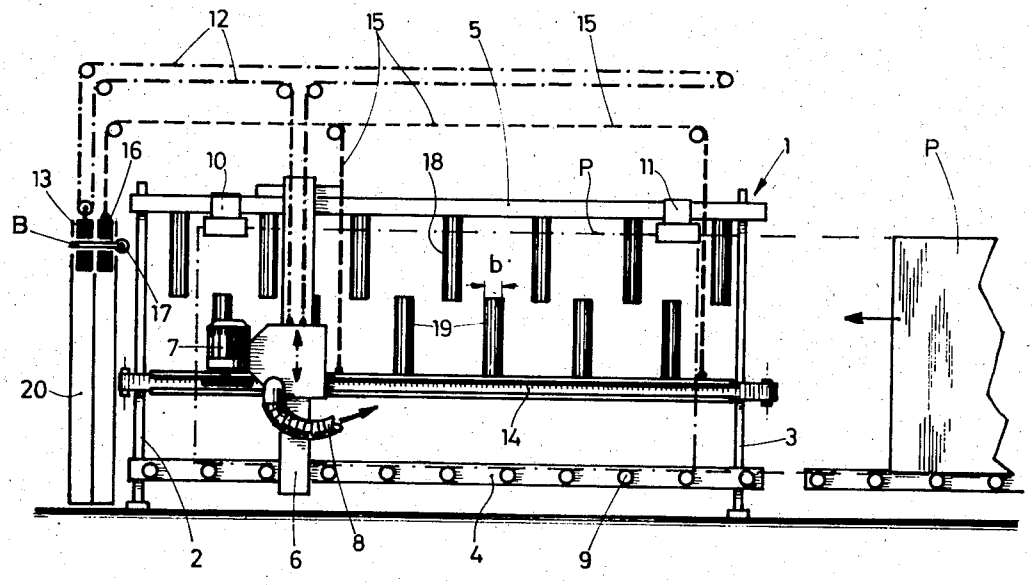

The invention relates to an apparatus for making horizontal and vertical cuts in laminar sawable objects such as sheets of wood, chipboards et cetera, and accordingly exhibits a frame oriented virtually upright, on which at least one motor-driven sawing unit is arranged which can be displaced in the vertical and/or horizontal direction in the frame plane, whilst the frame exhibits, in its lower edge region, elements to absorb the weight of the board and for the lateral displacement of the board parts, and, in the vertical frame plane, counterpressure means to absorb the reaction forces which occur during the sawing process.

Board saws of this type are known, which exhibit a timber grid consisting of horizontal bars, which is resiliently suspended, in order to support the in some cases heavy boards. The arrangement here is chosen so that the grid escapes automatically as soon as the saw blade enters the region of a timber bar.

According to the conventional cutting method, therefore, a board was placed upon the frame of the board saw, generally on bottom guide rollers, whereupon the required board part was measured off from the top and parted by a horizontal cut. Accordingly the parted section had to be removed and placed aside manually, whereupon the lower residual section has to be removed and the required section to be brought into its place in order to perform the required vertical cuts.

This relatively complicated and time-wasting process has been replaced recently by a work method, according to which the entire board is firmly held at its top edge by tension claws before cutting commences. The required board section is then, contrary to the previous method—measured off from the bottom edge of the board and parted, whereupon the upper residual section can be raised somewhat in order to perform the vertical cuts required in the lower section. As soon as the lower section has been subdivided as required, its parts can be pushed aside, whereupon the upper residual section can be lowered onto the support rollers and subdivided by further vertical and/or horizontal cuts as required.

Although this method has proved successful from the standpoint of work/time economy, it nevertheless possesses an unmistakeable disadvantage from the standpoint of injury risk. There is in fact a risk, during the lowering of the, in some cases heavy, board sections, of the operator placing his hand between the bottom edge of the board and a horizontal bar of the timber grid, which may result in severe contusions.

The mere omission of the horizontal timber bars of the support grid, which might appear obvious, cannot be considered because the horizontal support is absolutely necessary to absorb the reaction forces corresponding to the sawing pressure.

It is therefore the aim of the invention to propose an apparatus of the above-mentioned type, whereby on the one hand the described accident risk is reliably eliminated, and on the other hand the satisfactory support of the board during the sawing process is ensured.

It is therefore the unexpected basic idea underlying this invention, on the one hand to restrict the horizontal support, which is absolutely necessary, to the sawing region only, and on the other hand to make it movable so that it can follow the sawing unit in its vertical displacement.

An exemplary embodiment of the object of the invention is described below with reference to the accompanying drawing. The sole FIGURE of the drawing shows a simplified elevation of a preferred embodiment of the apparatus according to the invention.

The apparatus illustrated in the drawing, with nonessential details omitted, exhibits a frame, generally designated 1, which exhibits two vertical columns 2 and 3 and two horizontal girders 4 and 5 firmly connected to the vertical columns. A guide beam 6 is arranged on the two horizontal girders 4 and 5 through the intermediary of wheels and rails so that it can be moved in horizontal reciprocation along the total length of the frame 1. The sawing unit 7, which is attached to the guide beam 6, is, on the one hand, vertically reciprocally slidable along the guide beam 6, and can, on the other hand, be pivoted as required, so that the circular saw blade assumes a horizontal or vertical cutting position.

An exhaust pipe 8, which serves to discharge the sawdust produced, and which is connected to a vacuum source not shown, ends at the sawing unit 7. The lower horizontal girder 4 is provided with rollers 9 mounted for free rotation, upon which a wooden board P, indicated by chain-dotted lines, is supported. According to a known work method the board P is retained by at least one vertically reciprocally movable clamp claw 10 or 11 arranged on the upper girder 5. After a lower board section has been parted by a horizontal cut, in the case of this arrangement the upper board section can be raised somewhat, whereupon the lower one can be further subdivided by vertical cuts and then discharged to the left on the rollers 9; the upper residual section can now be lowered onto the rollers 9 and likewise be subdivided vertically or horizontally.

In order to compensate the weight of the sawing unit 7, the latter is connected by a cable 12 to a counterweight 13. The cable 12 is passed over the pulleys illustrated so that, at each vertical displacement of the sawing unit 7, the counterweight 13 moves by a corresponding amount in the opposite direction. In this manner the sawing unit 7 can easily be guided manually along the guide beam 6 during vertical cutting.

A horizontal support beam 14 is guided slidably parallel to itself in the vertical direction on the two columns 2 and 3. This support beam 14 is likewise engaged by a cable 15, which is connected via pulleys to a counterweight 16. The two counteweights 13 and 16 are guided in two parallel guide tracks in a vertical shaft 20, and are provided with bores B in the embodiment illustrated. As soon as the two counterweights are at equal height, as the FIGURE shows, they can be coupled by a bolt 17 which penetrates both bores B and thus couples the two counterweights to form a rigid entity.

In a preferred embodiment, it is further provided that the support beam 14 is provided with a conventional drive means which guides the support beam automatically to the level of the saw blade as soon as the sawing unit 7 is pivoted into the horizontal cutting position. If the apparatus is provided with two sawing units, one of which is intended for horizontal cutting and the other for vertical cutting, then the support beam obviously always follows the vertical displacement of the horizontal cutting saw.

Instead of the mechanical coupling by means of the plug-in bolt 17, it would also obviously be possible to chose a different mode of coupling. For example, according to a particularly advantageous embodiment, each counterweight (e.g. 13) exhibits a solenoid facing the other counterweight (e.g. 16), so that the coupling can be effected by simply closing an electrical contact. It is further provided in the case of this variant that the electromagnetic coupling occurs whenever the saw blade has assumed its work position in the region of the support beam and the sawing unit also occupies its horizontal cutting position. The electrical circuit means required for this purpose, including the associated contacts, may be assumed to be known to the expert and is therefore not described in detail.

Referring to the supporting of the wooden board P, a plurality of support arms 18 are further attached to the upper girder 5, extending from the girder 5 downwards over a fraction, for example one third, of the frame height, and should have a mutual interval corresponding at least to the width b of each support arm. Similarly a plurality of upwardly projecting support arms 19 are attached to the support beam 14, so that they project into the interstices between adjacent support arms 18 when the support beam 14 is raised. The support arms 18 and 19 are constructed as circular cylindrical hollow plastic elements, for example.

The described apparatus operates as follows: after a wooden board P to be cut has been presented from the right in the direction of the arrow and placed upon the rollers 9 of the frame 1, the top edge of the board is gripped by means of the clamp claws 10 and 11. The sawing unit is then brought into the horizontal cutting position, whereupon the support beam is either brought manually to the level of the saw blade, or in the case of the preferred variant, automatically assumes this position. The two counterweights 13 and 16 are then coupled mechanically, electromagnetically or by other means depending upon the embodiment so that the support beam 14 remains precisely at the level of the saw blade for the duration of the horizontal cutting.

After the horizontal cutting has been performed, the upper board section is raised somewhat by means of the claws 10 and 11, whereupon the lower board section is further subdivided by vertical cuts and then transported away to the left on the rollers 9. Now, by lowering the claws 10 and 11, the upper board section is placed upon the rollers 9 and further subdivided by horizontal and/or vertical cuts.

It is of particular significance in the above-described arrangement that the board P is ideally supported by the support beam 14 along the total cutting length during the horizontal cut, whilst the saw blade can dip either above or below the support beam or into a slot arranged in the support beam. The movable support system formed by the support arms 18 and 19 virtually excludes the catching of fingers. The lower parted board section is also supported at the rear thereby.

I claim:

1. Apparatus for making horizontal and vertical cuts comprising: an upright frame; at least one motor-driven sawing unit supported by the upright frame displaceable in the vertical and horizontal direction; means for absorbing the weight of a board being cut by the sawing unit and for laterally displacing the board and parts cut from the board supported by a lower region of the frame; downwardly extending counterpressure means for absorbing the reaction forces in the board which occur during the sawing of the board supported by the frame; a vertically slidable support beam mounted on the upright frame and extending along the length of the frame for supporting the board during the displacement of the sawing unit in the horizontal direction; upwardly extending counterpressure means supported by the support beam for absorbing the reaction forces in the board; and means for coupling the vertical movement of the support beam with that of the sawing unit so that the horizontal cutting of the board always occurs in the region of support of the support beam.

2. The invention recited in claim 1, wherein the sawing unit is pivotable into a horizontal or vertical work position and is connected by a first connecting element to a first vertically slidable counterweight and wherein the support beam is connected through a second connecting element to a second vertically slidable counterweight, and wherein the first and second counterweights are couplable.

3. The invention recited in claim 2, wherein the first and second counterweights are guided in parallel in a vertical shaft.

4. The invention recited in claim 3, wherein the first and second counterweights each have at least one bore penetrable by a bolt so that the first and second counterweights can be coupled rigidly by the bolt when the first and second counterweights are at equal height.

5. The invention recited in claim 3, wherein each of the first and second counterweights further includes a solenoid facing the other counterweight, so that electromagnetic coupling of the two counterweights occurs when the sawing unit is in its horizontal cutting position and the support beam has reached the level of the sawing unit.

6. The invention recited in claim 1, wherein the downwardly extending counterpressure means includes a row of uniformly spaced upper support arms which extend downwards from the top edge of the frame, and the upwardly extending counterpressure means includes a row of lower support arms which project upwards from the support beam, wherein the lower support arms are staggered in the horizontal direction relative to the upper support arms so that they project into the interstices present between the upper support arms when the support beam is raised.

* * * * *